US006835264B2

(12) United States Patent
Sayovitz et al.

(10) Patent No.: US 6,835,264 B2
(45) Date of Patent: Dec. 28, 2004

(54) METHOD FOR PRODUCING CREPED NONWOVEN WEBS

(75) Inventors: John Joseph Sayovitz, Marietta, GA (US); Gregory Todd Sudduth, Cumming, GA (US); Charles Edward Edmundson, Roswell, GA (US); Howard Martin Welch, Woodstock, GA (US); Stephen Michael Campbell, Winneconne, WI (US); Wendy Marie Takken, Canton, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 155 days.

(21) Appl. No.: 10/026,179

(22) Filed: Dec. 20, 2001

(65) Prior Publication Data

US 2003/0119412 A1 Jun. 26, 2003

(51) Int. Cl.[7] ..... B31F 1/12

(52) U.S. Cl. ..... 156/183; 162/111; 162/113; 264/283; 442/327

(58) Field of Search ..... 162/280, 281, 162/282, 111, 112, 113, 132; 264/283; 156/183, 277, 290, 291; 428/152, 153, 154; 442/327

(56) References Cited

U.S. PATENT DOCUMENTS

| | | | |
|---|---|---|---|
| 3,338,992 | A | 8/1967 | Kinney |
| 3,341,394 | A | 9/1967 | Kinney |
| 3,502,763 | A | 3/1970 | Hartman |
| 3,542,615 | A | 11/1970 | Dobo et al. |
| 3,665,921 | A | 5/1972 | Stumpf |
| 3,668,054 | A | 6/1972 | Stumpf |
| 3,673,060 | A | 6/1972 | Murphy et al. |
| 3,687,754 | A | 8/1972 | Stumpf |
| 3,692,618 | A | 9/1972 | Dorschner et al. |
| 3,694,867 | A | 10/1972 | Stumpf |
| 3,705,063 | A | 12/1972 | Stumpf |

(List continued on next page.)

FOREIGN PATENT DOCUMENTS

| | | |
|---|---|---|
| EP | 0 047 397 A1 | 3/1982 |
| EP | 0 865 755 A1 | 9/1998 |
| GB | 2122209 | 1/1984 |
| GB | 2179949 | 3/1987 |
| JP | 73-001443 | 5/1973 |
| SU | 797911 | 1/1981 |
| WO | 81/02704 | 10/1981 |
| WO | 84/00984 | 3/1984 |
| WO | 92/16371 | 10/1992 |
| WO | 95/22644 | 8/1995 |
| WO | 96/12615 | 5/1996 |
| WO | 98/46825 | 10/1998 |
| WO | 99/22619 | 5/1999 |
| WO | 99/23290 | 5/1999 |
| WO | 99/34060 | 7/1999 |
| WO | 00/33780 | 6/2000 |
| WO | 01/05346 | 1/2001 |

OTHER PUBLICATIONS

International Search Report dated Aug. 7, 2002, for International Application No. PCT/US02/13334.

*Primary Examiner*—Sue A. Purvis
(74) *Attorney, Agent, or Firm*—William D. Herrick

(57) ABSTRACT

The present invention provides a one or two step method for bonding and creping or double creping a nonwoven web. In the method of the present invention, a nonwoven web is adhered to a creping roll and bonded while on the creping roll. The bonding of the nonwoven adheres the nonwoven to the creping roll in a pattern of the bonding roll. Once creped from the creping roll, the resulting nonwoven web is creped in the pattern of the bonding roll. The creped nonwoven webs of the present invention are useful in a wide variety of application including as wipes, liners, transfer or surge layers, outercovers, other fluid handling materials and looped fastener materials.

19 Claims, 3 Drawing Sheets

U.S. PATENT DOCUMENTS 3,705,065 A 12/1972 Stumpf
3,708,361 A 1/1973 Stumpf
3,709,768 A 1/1973 Stumpf
3,720,554 A 3/1973 Stumpf
3,729,353 A 4/1973 Stumpf et al.
3,755,051 A 8/1973 Stumpf
3,783,072 A 1/1974 Korpman
3,802,817 A 4/1974 Matsuki et al.
3,816,228 A 6/1974 Stumpf
3,822,162 A 7/1974 Stumpf
3,849,241 A 11/1974 Butin et al.
3,855,046 A 12/1974 Hansen
3,976,734 A 8/1976 Dunning et al.
4,041,203 A 8/1977 Brock et al.
4,064,213 A 12/1977 Lazorisak et al.
4,088,731 A 5/1978 Groome
4,125,659 A 11/1978 Klowak et al.
4,294,936 A 10/1981 Korpman
4,304,625 A 12/1981 Grube et al.
4,340,563 A 7/1982 Appel et al.
4,421,812 A 12/1983 Plant
4,422,892 A 12/1983 Plant
4,429,014 A 1/1984 Isner et al.
4,435,458 A 3/1984 Hill
4,436,867 A 3/1984 Pomplun et al.
4,440,898 A 4/1984 Pomplun et al.
4,487,796 A 12/1984 Lloyd et al.
4,507,173 A 3/1985 Klowak et al.
4,543,099 A 9/1985 Bunnelle et al.
4,551,199 A 11/1985 Weldon
4,555,811 A 12/1985 Shimalla
4,610,743 A 9/1986 Salmeen et al.
4,652,487 A 3/1987 Morman
4,684,439 A 8/1987 Soerens
4,788,243 A 11/1988 Soerens
4,789,699 A 12/1988 Kieffer et al.
4,810,556 A 3/1989 Kobayashi et al.
4,886,579 A 12/1989 Clark et al.
4,915,763 A 4/1990 Swiszcz
5,026,458 A 6/1991 Beuther
5,078,935 A 1/1992 Kobayashi et al.
5,094,717 A 3/1992 Manning et al.
5,108,820 A 4/1992 Kaneko et al.
5,110,399 A 5/1992 Yoshida et al.
5,145,727 A * 9/1992 Potts et al. ..... 428/198
5,169,706 A 12/1992 Collier, IV et al.
5,261,146 A 11/1993 Belliot
5,272,236 A 12/1993 Lai et al.
5,302,443 A 4/1994 Manning et al.
5,322,728 A 6/1994 Davey et al.
5,336,552 A 8/1994 Strack et al.
5,382,400 A 1/1995 Pike et al.
5,571,619 A 11/1996 McAlpin et al.
5,614,281 A 3/1997 Jackson et al.
5,674,590 A 10/1997 Anderson et al.
5,704,101 A 1/1998 Majors et al.
5,707,468 A 1/1998 Arnold et al.
5,770,531 A 6/1998 Sudduth et al.
5,800,765 A 9/1998 Bradt
5,814,390 A 9/1998 Stokes et al.
5,858,515 A 1/1999 Stokes et al.
5,885,418 A 3/1999 Anderson et al.
5,888,607 A 3/1999 Seth et al.
5,904,971 A 5/1999 Anderson et al.
5,906,879 A 5/1999 Huntoon et al.
6,197,404 B1 3/2001 Varona
6,214,146 B1 4/2001 Merker
6,309,731 B1 10/2001 Takeuchi et al.
6,589,892 B1 * 7/2003 Smith et al. ..... 442/414

* cited by examiner

METHOD FOR PRODUCING CREPED NONWOVEN WEBS

FIELD OF INVENTION

The present invention relates to a method for producing a creped nonwoven fibrous web.

BACKGROUND OF THE INVENTION

Creping is a process in which a nonwoven fibrous web is adhered to a surface of a roll or drum using an adhesive and the adhered nonwoven web is mechanically removed from the surface of the roll or drum. This mechanical removing of the adhered nonwoven web debonds and disrupts the fibers within the nonwoven web, thereby increasing the absorbency, if absorbent fibers are used, softness, and bulk of the nonwoven web. Creping has also been used in the paper making art.

Traditionally in creping processes, adhesives have been used to attach a pre-bonded nonwoven fibrous web to a creping roll. Typically, water-based adhesives, such as latex adhesives, have been used to attach a nonwoven fibrous web to a creping roll or creping drum. In the prior processes used in the art, the fibers of the nonwoven web are bonded together, in a separate bonding step, before the nonwoven web is adhered to the creping roll.

Preparation of creped nonwoven webs is known in the art, for example, see U.S. Pat. No. 3,665,921, U.S. Pat. No. 3,668,054, U.S. Pat. No. 3,687,754, U.S. Pat. No. 3,694,867, U.S. Pat. No. 3,705,063, and U.S. Pat. No. 3,705,065, all issued to Stumpf, and hereby incorporated by reference in their entirety. In each of the above-mentioned patents to Stumpf, a high loft nonwoven web having a multiplicity of looped fibers is produced. The Stumpf patents do not teach bonding the nonwoven web while the nonwoven web is on the creping roll or drum.

U.S. Pat. No. 4,810,556, issued to Kobayashi et al. discloses a process of producing a creped nonwoven web by coating an uncreped nonwoven fabric with a lubricant and then pressing the nonwoven fabric between a drive roll and a plate having a rough surface. The plate is positioned near the drum and is substantially parallel or tangential to the outer surface of the drum. The nonwoven web is crinkled in a wavelike fashion in the direction of movement by the frictional force caused by the pressing. The resulting nonwoven web is creped, which contributes to the softness of the nonwoven web.

In addition, the preparation of creped thermoplastic nonwoven webs is described in WO 99/22619, and U.S. Pat. No. 6,197,404 issued to Verona, both assigned to Kimberly-Clark Worldwide, Inc and hereby incorporated by reference in their entirety. The creped nonwoven web of WO '619 and U.S. '404 has a permanent crepe, wherein regions of interfilament bonding, which are permanently bent out-of-plane, are alternated with regions of no interfilament bonding. In the process disclosed in WO '619 and U.S. '404, a doctor blade is used to crepe the nonwoven fabric from the creping roll. The nonwoven web is supplied to the creping roll from a roll of pre-bonded, uncreped nonwoven web.

Therefore, there is a need in the art for a process of bonding and creping a nonwoven web in a single step process which can be easily added to the nonwoven web formation process.

SUMMARY OF THE INVENTION

The present invention provides an improved method of producing creped nonwoven fibrous webs derived from thermoplastic polymers. The process of the present invention provides an effective method of bonding and creping thermoplastic nonwoven webs in the nonwoven web production line.

The method of the present invention prepares a pattern bonded and creped nonwoven web wherein the method comprises a) providing a nonwoven fibrous web having a first side and a second side, the nonwoven fibrous web comprises thermoplastic fibers;

b) transferring and adhering the nonwoven fibrous web to a first roll, such that the first side of the nonwoven fibrous web faces the first roll;

c) bonding the nonwoven fibrous web transferred and adhered to the first roll by contacting the nonwoven fibrous web with a second roll comprising a pattern, such that the nonwoven fibrous web is passed between a nip formed between the first roll and the second roll to form a bonded nonwoven web; and d) removing the bonded nonwoven web from the first roll by creping the bonded nonwoven web from the first roll to produce a creped nonwoven web.

In a second method of the present invention, both sides of the nonwoven web can be creped. When both sides of the nonwoven web are creped, the process described above further comprises e) transferring and adhering the second side of the nonwoven web to a third roll by contacting the second side of the nonwoven fibrous web with the third roll; and f) removing the nonwoven fibrous web adhered to the third roll by creping the nonwoven fibrous web from the third roll with a creping blade to produce a creped thermoplastic nonwoven web which is creped on both the first and second sides.

DEFINITIONS

Figure 1:
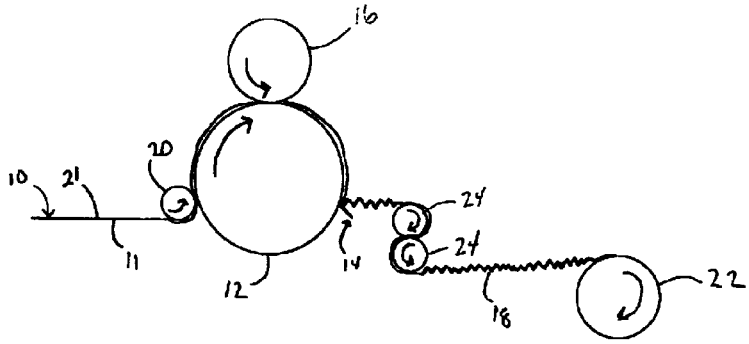
FIG. 1 generally shows a schematic diagram of the apparatus used to practice the methods of the present invention.

As used herein, the term "nonwoven fibrous web" means a web having a structure of individual fibers or threads which are interlaid, but not in an identifiable manner as in a knitted web. Nonwoven fibrous webs have been formed from many processes, such as, for example, meltblowing processes, spunbond processes, and carded web processes. As used herein, this term is intended to mean an unbonded web, i.e. a web where interfilament bonding has not occurred to any great extent.

As used herein, the term "bonded nonwoven web" means a nonwoven web which has been subjected to a bonding procedure where some of the interlaid fibers or threads are bonded together using a known bonding procedure. Examples of bonding procedures include, but are not limited to, ultrasonic bonding, and thermal calendering. The basis weight of bonded nonwoven webs is usually expressed in ounces of material per square yard (osy) or grams per square meter (gsm) and the fiber diameters useful are usually expressed in microns, or in the case of staple fibers, denier. It is noted that to convert from osy to gsm, multiply osy by 33.91.

As used herein, the term "spunbond fibers" refers to small diameter fibers which are formed by extruding molten thermoplastic material as filaments from a plurality of fine, usually circular capillaries of a spinneret with the diameter of the extruded filaments then being rapidly reduced as by, for example, U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman; U.S. Pat. No. 3,542,615 to Dobo et al.; and U.S. Pat. No. 5,382,400 to Pike et al.; the entire content of each is incorporated herein by reference. Spunbond fibers are generally not tacky when they are deposited onto a collecting surface. Spunbond fibers are generally continuous and have average diameters (from a sample of at least 10) larger than 7 microns, more particularly, between about 10 and 40 microns.

As used herein the term "meltblown fibers" means fibers of polymeric material which are generally formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter. Thereafter, the meltblown fibers can be carried by the high velocity gas stream and are deposited on a collecting surface to form a web of randomly dispersed meltblown fibers. Such a process is disclosed, for example, in U.S. Pat. No. 3,849,241 to Butin et al., which is hereby incorporated by reference in its entirety. Meltblown fibers may be continuous or discontinuous, are generally smaller than 10 microns in average diameter, and are generally tacky when deposited onto a collecting surface.

As used herein "thermal point bonded" means bonding one or more fabrics with a pattern of discrete bond points. As an example, thermal point bonding often involves passing a fabric or web of fibers to be bonded between a pair of heated bonding rolls (calendering rolls). One of the bonding rolls is usually, though not always, patterned in some way so that the entire fabric is not bonded across its entire surface, and the second or anvil roll is usually a smooth surface. As a result, various patterns for calender rolls have been developed for functional as well as aesthetic reasons. One example of a pattern has points and is the Hansen Pennings or "H&P" pattern with about a 30% bond area with about 200 bonds/square inch as taught in U.S. Pat. No. 3,855,046 to Hansen and Pennings. The H&P pattern has square point or pin bonding areas wherein each pin has a side dimension of 0.038 inches (0.965 mm), a spacing of 0.070 inches (1.778 mm) between pins, and a depth of bonding of 0.023 inches (0.584 mm). The resulting pattern has a bonded area of about 29.5%. Another typical point bonding pattern is the expanded Hansen Pennings or "EHP" bond pattern which produces a 15% bond area with a square pin having a side dimension of 0.037 inches (0.94 mm), a pin spacing of 0.097 inches (2.464 mm) and a depth of 0.039 inches (0.991 mm). Another typical point bonding pattern designated "714" has square pin bonding areas wherein each pin has a side depth of bonding of 0.033 inches (0.838 mm). The resulting pattern has a bonded area of about 15%. Yet another common pattern is the C-Star pattern which has a bond area of about 16.9%. The C-Star pattern has a cross-directional bar or "corduroy" design interrupted by shooting stars. Other common patterns include a diamond pattern with repeating and slightly offset diamonds with about a 16% bond area and a wire weave pattern, having generally alternating perpendicular segments, with about a 19% bond area. Typically, the percent bonding area varies from around 10% to around 30% of the area of the fabric laminate web. Point bonding may be used to hold the layers of a laminate together and/or to impart integrity to individual layers by bonding filaments and/or fibers within the web.

As used herein "pattern unbonded" or interchangeably "point unbonded" or "PUB", means a fabric pattern having continuous bonded areas defining a plurality of discrete unbonded areas. The fibers or filaments within the discrete unbonded areas are dimensionally stabilized by the continuous bonded areas that encircle or surround each unbonded area, such that no support or backing layer of film or adhesive is required. The unbonded areas are specifically designed to afford spaces between fibers or filaments within the unbonded areas. A suitable process for forming the pattern-unbonded nonwoven material of this invention includes providing a nonwoven fabric or web, providing opposedly positioned first and second calender rolls and defining a nip there between, with at least one of the rolls being heated and having a bonding pattern on its outermost surface comprising a continuous pattern of land areas defining a plurality of discrete openings, apertures or holes, and passing the nonwoven fabric or web within the nip formed by the rolls. Each of the openings in the roll or rolls defined by the continuous land areas forms a discrete unbonded area in at least one surface of the nonwoven fabric or web in which the fibers or filaments of the web are substantially or completely unbonded. Stated alternatively, the continuous pattern of land areas in the roll or rolls forms a continuous pattern of bonded areas that define a plurality of discrete unbonded areas on at least one surface of the nonwoven fabric or web. The PUB pattern is further described in U.S. Pat. No. 5,858,515 to Stokes et al, the entire contents of which are hereby incorporated by reference.

As used herein, the term "hot air knife" or HAK means a process of preliminary bonding a just produced nonwoven fibrous web, particularly spunbond, in order to give it sufficient integrity, i.e. increase the stiffness of the web, for further processing, but does not mean the relatively strong bonding of primary bonding processes like through-air bonding, thermal bonding and ultrasonic bonding. A hot air knife is a device which focuses a stream of heated air at a very high flow rate, generally from about 1000 to about 10,000 feet per minute (fpm) (305 to 3050 meters per minute), or more particularly from about 3000 to 6000 feet per minute (915 to 1830 meters per minute) directed at the nonwoven web immediately after the nonwoven web formation. The air temperature is usually in the range of the melting point of at least one of the polymers used in the web, generally between about 200° and 550° F. (93° and 290° C.) for the thermoplastic polymers commonly used in spunbonding. However, the temperature of the air must be adjusted accordingly for the particular polymers used to prepare the nonwoven web. The control of air temperature, velocity, pressure, volume and other factors helps avoid damage to the web while increasing its integrity. The HAK's focused stream of air is arranged and directed by at least one slot of about ⅛ to 1 inches (3 to 25 mm) in width, particularly about ⅜ inch (9.4 mm), serving as the exit for the heated air towards the web, with the slot running in a substantially cross-machine direction over substantially the entire width of the web. In other embodiments, there may be a plurality of slots arranged next to each other or separated by a slight gap. At least one slot is usually, though not essentially, continuous, and may be comprised of, for example, closely spaced holes. The HAK has a plenum to distribute and contain the heated air prior to its exiting the slot. The plenum pressure of the HAK is usually between about 1.0 and 12.0 inches of water (2 to 22 mmHg), and the HAK is positioned between about 0.25 and 10 inches and more preferably 0.75 to 3.0 inches (19 to 76 mm) above the forming wire. In a particular embodiment the HAK plenum's cross sectional area for cross-directional flow (i.e. the plenum cross sectional area in the machine direction) is at least twice the total slot exit area. Since the forming wire onto which spunbond polymer is formed generally moves at a high rate of speed, the time of exposure of any particular part of the web to the air discharged from the hot air knife is less a tenth of a second and generally about a hundredth of a second in contrast with the through-air bonding process which has a much larger dwell time. The HAK process has a great range of variability and controllability of many factors such as air temperature, velocity, pressure, volume, slot or hole arrangement and size, and the distance from the HAK plenum to the web. The HAK is further described in U.S. Pat. No. 5,707,468 to Arnold et al., the entire contents of which is incorporated by reference.

As used herein, the term "polymer" generally includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

As used herein, the term "conjugate fibers" refers to fibers or filaments which have been formed from at least two polymers extruded from separate extruders but spun together to form one fiber. Conjugate fibers are also sometimes referred to as multicomponent or bicomponent fibers filaments. The polymers are usually different from each other though conjugate fibers may be monocomponent fibers. The polymers are arranged in substantially constantly positioned distinct zones across the cross-section of the conjugate fibers or filaments and extend continuously along the length of the conjugate fibers or filaments. The configuration of such a conjugate fiber may be, for example, a sheath/core arrangement, wherein one polymer is surrounded by another, a side-by-side arrangement, a pie arrangement or an "islands-in-the-sea" arrangement. Conjugate fibers are taught in U.S. Pat. No. 5,108,820 to Kaneko et al., U.S. Pat. No. 5,336,552 to Strack et al., and U.S. Pat. No. 5,382,400 to Pike et al., the entire content of each is incorporated herein by reference. For two component fibers or filaments, the polymers may be present in ratios of 75/25, 50/50, 25/75 or any other desired ratios.

As used herein, the term "multiconstituent fibers" refers to fibers which have been formed from at least two polymers extruded from the same extruder as a blend or mixture. Multiconstituent fibers do not have the various polymer components arranged in relatively constantly positioned distinct zones across the cross-sectional area of the fiber and the various polymers are usually not continuous along the entire length of the fiber, instead usually forming fibrils or protofibrils which start and end at random.

The term "blend", as used herein, means a mixture of two or more polymers while the term "alloy" means a sub-class of blends wherein the components are immiscible but have been compatibilized. "Miscibility" and "immiscibility" are defined as blends having negative and positive values, respectively, for the free energy of mixing. Further, "compatibilization" is defined as the process of modifying the interfacial properties of an immiscible polymer blend in order to make an alloy.

As used herein, the phrase "nonwoven web bond pattern" is a pattern of interfilament bonding in the nonwoven web which is imparted during manufacture of the nonwoven web.

As used herein, the term "microfibers" means small diameter fibers having an average diameter not greater than about 100 microns, for example, having an average diameter of from about 0.5 microns to about 50 microns, or more particularly, an average diameter of from about 4 microns to about 40 microns.

"Creped" refers to a bonded nonwoven web having portions which are bent out-of-plane using a variety of creping techniques known in the art. Creped nonwoven webs have top and/or bottom surfaces which define a three-dimensional structure. The three-dimensional structure is manifested in the form of puckering, waves, peaks and valleys, etc., so that some regions of the nonwoven web are substantially elevated or depressed relative to adjacent regions.

"Permanently creped" refers to a creped nonwoven web having bonded and unbonded areas, in which the bonded areas are permanently bent out-of-plane and the unbonded portions are permanently looped, such that the nonwoven web cannot be returned to its original uncreped state by applying a mechanical stress, such as may be encountered during further processing or use conditions.

"Crepe level" is a measure of creping and is calculated according to the following equation:

$$\text{Crepe level (\%)} = \frac{\text{Speed of Creping Surface minus speed of windup reel for the creped web}}{\text{Speed of Creping Surface}} \times 100$$

"Bent out-of-plane" refers to a bonding or orientation of portions of the nonwoven web in a direction away from the plane in which the nonwoven web substantially lies before being subjected to the creping process. As used herein, the phrase "bent out-of-plane" generally refers to nonwoven webs having creped portions bent at least about 15 degrees away from the plane of the uncreped nonwoven web, preferably at least about 30 degrees.

"Looped" refers to unbonded filaments or portions of filaments in a creped nonwoven web which define an arch, semi-circle or similar configuration extending above the plane of the uncreped nonwoven web, and terminating at both ends in the nonwoven web (e.g., in the bonded areas of the creped nonwoven web).

DETAILED DESCRIPTION OF THE INVENTION

The method of the present invention provides a bonded and creped nonwoven web. The method includes a) providing a nonwoven fibrous web having a first side and a second side, wherein the nonwoven fibrous web contains thermoplastic fibers;

b) transferring and adhering the nonwoven fibrous web to a first roll, such that the first side of the nonwoven fibrous web faces the first roll;

c) bonding the nonwoven fibrous web transferred and adhered to the first roll by contacting the nonwoven fibrous web with a second roll comprising a pattern such that the nonwoven fibrous web is passed between a nip formed between the first roll and the second roll to form a bonded nonwoven web; and d) removing the bonded nonwoven web from the first roll by creping the bonded nonwoven web from the first roll to produce a creped nonwoven web.

In the practice of the present invention, any manufacturing process known to those skilled in the art can be used to produce nonwoven fibrous webs of thermoplastic fibers which are to be bonded and creped in accordance with the process of the present invention. These manufacturing processes include, but are not limited to, a spunbond process, a meltblown process, an air-laid process and a carded web process.

In addition, multilayer laminates of nonwoven fibrous webs can also be used in the practice of the present invention. Multilayer laminates are known in the art and may be formed by a number of different techniques, including but not limited to, using an adhesive, needle punching, ultrasonic bonding, thermal calendering and through-air bonding. Examples of multilayer laminates include laminates wherein some of the layers are spunbond and some of the layers are meltblown, such as spunbond/meltblown/spunbond (SMS) laminate as disclosed in U.S. Pat. No. 4,041,203 to Brock et al. and U.S. Pat. No. 5,169,706 to Collier et al., each hereby incorporated in their entirety. Generally, the SMS is prepared by depositing a spunbond layer onto a moving conveyor belt or forming wire, then a meltblown layer is deposited onto the spunbond layer and a second spunbond layer is deposited onto the meltblown layer. Once all of the layers are deposited, the laminate is bonded in a manner described above. Other laminates include a spunbond/spunbond laminate made by sequentially depositing spunbond layers onto a moving conveyor belt or forming wire and bonding the resulting laminate. As an alternative process, laminates can be prepared by first preparing each of the layers individually and collecting the layer on rolls. The rolls are then loaded onto another machine which unrolls each of the layers and laminates the layers together using a bonding method described above. When a laminate is prepared by the process of the present invention, some or all of the layers should be unbonded. The bonding of the layers of the laminate in the present invention is performed while the laminate is adhered to the first roll and the bond pattern of the second roll in imparted to the multilayer laminate.

Any thermoplastic polymer can be used to produce the nonwoven fibrous web. The selection of the thermoplastic polymer is not critical to the present invention. The polymers suitable for the present invention include polyolefins, polyesters, polyamides, polycarbonates, polyurethanes, polyvinylchloride, polytetrafluoroethylene, polystyrene, polyethylene terephathalate, biodegradable polymers such as polylactic acid and copolymers and blends thereof. Suitable polyolefins include polyethylene, e.g., high density polyethylene, medium density polyethylene, low density polyethylene and linear low density polyethylene; polypropylene, e.g., isotactic polypropylene, syndiotactic polypropylene, blends of isotactic polypropylene and atactic polypropylene, and blends thereof; polybutylene, e.g., poly (1-butene) and poly(2-butene); polypentene, e.g., poly(1-pentene) and poly(2-pentene); poly(3-methyl-1-pentene); poly(4-methyl 1-pentene); and copolymers and blends thereof. Suitable copolymers include random and block copolymers prepared from two or more different unsaturated olefin monomers, such as ethylene/propylene and ethylene/butylene copolymers. Suitable polyamides include nylon 6, nylon 6/6, nylon 4/6, nylon 11, nylon 12, nylon 6/10, nylon 6/12, nylon 12/12, copolymers of caprolactam and alkylene oxide diamine, and the like, as well as blends and copolymers thereof. Suitable polyesters include polyethylene terephthalate, polybutylene terephthalate, polytetramethylene terephthalate, polycyclohexylene-1,4-dimethylene terephthalate, and isophthalate copolymers thereof, as well as blends thereof.

Many polyolefins are available for fiber production, for example polyethylenes such as Dow Chemical's ASPUN 6811A linear low-density polyethylene, 2553 LLDPE and 25355 and 12350 high density polyethylene are such suitable polymers. The polyethylenes have melt flow rates in g/10 min. at 190° F. and a load of 2.16 kg, of about 26, 40, 25 and 12, respectively. Fiber forming polypropylenes include Exxon Chemical Company's ESCORENE PD3445 polypropylene. Many other polyolefins are commercially available and generally can be used in the present invention. The particularly preferred polyolefins are polypropylene and polyethylene.

Metallocene-catalyzed polyolefins are also useful, including those described in U.S. Pat. Nos. 5,571,619; 5,322,728; and 5,272,236, the disclosures of which are incorporated herein by reference. Polymers made using metallocene catalysts have a very narrow molecular weight range. Polydispersity numbers (Mw/Mn) of below 4 and even below 2 are possible for metallocene-produced polymers. These polymers also have a controlled short chain branching distribution compared to otherwise similar Ziegler-Natta produced type polymers. It is also possible using a metallocene catalyst system to control the isotacticity of the polymer quite closely.

The nonwoven fibrous web to be bonded and creped in accordance with this invention can be prepared from monocomponent fibers, conjugate fibers, multiconstituent fibers and blends of fibers.

FIG. 1 shows a general schematic of the process of the present invention. A nonwoven fibrous web 10, having a first side 11 and a second side 21, is supplied to the process of the present invention directly from the nonwoven web formation process. Generally, the nonwoven fibrous web has not been previously bonded, however, the nonwoven web may be subjected to a HAK treatment, so that the nonwoven fibrous web has some integrity such that the nonwoven fibrous web can be adhered to the creping roll. A press roll 20, which is optional, engages the first side 11 of the nonwoven fibrous web 10 with the creping roll 12 by guiding the nonwoven fibrous web 10 onto the creping roll 12. The press roll 20, when present, also supplies sufficient pressure to the nonwoven fibrous web 10 to adhere the nonwoven fibrous web 10 to the creping roll 12. When a press roll 20 is not used in the process, the pressure supplied by the bonding roll 16 will adhere the nonwoven fibrous web to the creping roll.

In order to adhere the nonwoven fibrous web 10 to the creping roll 12, a bonding agent may be used. The bonding agent may function through external bonding when applied to the nonwoven fibrous web 10 or applied onto the creping roll 12. Examples of bonding agents include, but are not limited to, adhesives capable of holding the nonwoven fibrous web 10 to the creping roll 12. The external bonding agents which can be used in the present invention include an aqueous based adhesive, a hot melt adhesive, or a solvent based adhesive.

When an aqueous based adhesive or a solvent based adhesive is used, it is necessary to remove the water or solvent from the adhesive composition. Suitable means of removing the water or solvent include heating the creping roll 12, or applying heat to the aqueous or solvent based adhesive from an external source, such as blowing hot air over the surface of the creping roll 12 and nonwoven fibrous web 10, among other methods known to those skilled in the art.

Hot melt adhesives are the preferred external bonding agents for adhering the nonwoven fibrous web to the creping roll 12. Hot melt adhesives typically exist as solid masses at ambient temperature and can be converted to a flowable liquid by the application of heat. By definition, a hot melt adhesive does not contain a liquid carrier and can be formulated to be tacky when in the molten state. In addition, hot melt adhesives can be formulated to be tacky at room temperature. The room temperature tacky hot melt adhesives are sometimes referred to as "pressure sensitive adhesives". The adhesive solidifies on cooling to form a strong bond between the nonwoven fibrous web 10 and the creping roll 12. One major advantage of hot melt adhesives is the lack of a liquid carrier, which are present in water and solvent based adhesives. Using a hot melt adhesive eliminates the costly processes associated with liquid carrier removal from the adhesive, not to mention the dangers often associated with solvent based adhesives.

Hot melt adhesives are generally heated to a temperature at least to the melting point of the hot melt adhesive. Generally, the melting point of hot melt adhesives is above ambient temperature and is often in the range of about 60° C. to about 200° C. Many different commercially available hot melt adhesive compositions can be used in the present invention. It will be apparent to those skilled in the art which hot melt adhesives can be used in the creping process of the present invention. It is preferred, although not required, that the hot melt adhesive is prepared from hydrophobic materials. When a hot melt adhesive is hydrophobic, the resulting creped nonwoven web will tend to have hydrophobic properties. It is also preferred that the hot melt adhesive has a relativity low melting point, generally in the range of about 60° C. to about 125° C., since higher melting point hot melt adhesives may detrimentally affect the thermoplastic nonwoven fibrous web, in particular, melt the fibers of the nonwoven fibrous web. Examples of preferred hot melt adhesives include, but are not limited to, styrene/rubber block copolymers, polybutylene, EVA, polyester, polyamide, or olefin based adhesives. Commercial examples of hot melt adhesives usable in the present include, but are not limited to, RT2115, RT 2130, RT 2315, RT2330 and RT 2730 available from Huntsman Polymer Corporation of Odessa, Tex.; H2525A, and H2096 available from Bostick-Findley Corp of Wauwatosa, Wis.; NS5610 and NS34-2950 available from National Starch and Chemical Company of Bridgewater, N.J.; and Shell 8911 available from Shell Chemical, Houston Tex.

As an alternative, an internal bonding agent, also called an "adhesive additive", can be added to polymers used to produce the fibers of the nonwoven fibrous web. The adhesive additive can be any additive which will increase the adhesion of the nonwoven fibrous web to the creping roll. Examples of adhesive additives include, but are not limited to, tackifying resins, pressure sensitive adhesives and the like. Any tackifying resin or pressure sensitive adhesive can be used. The only requirements for the adhesive additive is that the adhesive additive is compatible with the thermoplastic polymer and the adhesive additive can withstand the high processing (e.g., extrusion) temperatures. The term "compatible" is understood by those skilled in the art as to mean that the components of the mixture do not phase separate to any great degree once mixed. Further, the adhesive additive also needs to be compatible with other additives, such as processing aids, fillers and the like, which may be present in the thermoplastic polymeric composition used to prepare the fibers of the nonwoven fibrous web. As an alternative, however, the adhesive additive may be semi-compatible at the use temperature. When semi-compatible, the adhesive additive may be forced to the polymer surface where it may be most effective. Ways to force the additive to the surface include heating the formed fibers. This heating may be supplied by any means known to those skilled in the art, including heating the creping roll and using an external heat source.

Generally, hydrogenated hydrocarbon resins are preferred tackifying resins, because of their better temperature stability. REGALREZ® and ARKON® P series tackifiers are examples of hydrogenated hydrocarbon resins. ZONATAC®501 is an example of a terpene hydrocarbon. REGALREZ® hydrocarbon resins are available from Hercules Incorporated and are fully hydrogenated α-methyl styrene-type low molecular weight hydrocarbon resins, produced by polymerization and hydrogenation of pure monomer hydrocarbon feed stocks. Grades 1094, 3102, 6108 and 1126 are highly stable, light-colored low molecular weight, nonpolar resins suggested for use in plastics modification. ARKON P series resins are available from Arakawa Chemical (U.S.A.) Incorporated. ZONATAC®501 lite resin, a product of Arizona Chemical Co., has a softening point of 105° C., a Gardner color 1963 (50% in heptane) of 1 and a Gardener color neat (pure) (50% in heptane); APHA color=70) of water white, a specific gravity (25°/25° C.) of 1.02 and a flash point (closed cup, ° F.) of 480° F. Of course, the present invention is not limited to use of such three tackifying resins, and other tackifying resins which are compatible with the thermoplastic components of the nonwoven web and can withstand the high processing temperatures, can also be used. Examples of other tackifying resins are given U.S. Pat. Nos. 4,789,699, 4,294,936 and 3,783,072, the contents of which, with respect to the tackifier resins, are incorporated herein by reference.

A pressure sensitive elastomer adhesive may include, for example, from about 40 to about 80 percent by weight elastomeric polymer, from about 5 to about 40 percent polyolefin and from about 5 to about 40 percent resin tackifier. For example, a particularly useful composition includes, by weight, about 61 to about 65 percent KRATON® G-1657, about 17 to about 23 percent Polyethylene NA-601, and about 15 to about 20 percent REGALREZ® 1126.

In addition, the adhesive additive may be polymers which are inherently tacky, such as polybutene, polybutylene and the like. Again, it is important to note that the adhesive additive should be compatible, or at least semi-compatible with the thermoplastic polymer used to prepare the fiber and/or filaments of the nonwoven fibrous web. Commercial examples of adhesive additives include, but are not limited to Shell 8911, Shell DP 8611 and Shell SP 8510, which are available from Shell Chemical, Houston, Tex.

Generally, the adhesive additive is added in amount of about 0.5 to about 15 parts by weight based on the weight of the thermoplastic polymer. Preferably, the adhesive additive should be about 1 to about 10 parts by weight, and more preferably about 2 to about 7 parts by weight.

In the practice of the present invention, it is preferred, but not required, that the either an external hot melt adhesive or an internal adhesive is used to adhere the nonwoven fibrous web to the creping roll.

Figure 2A:
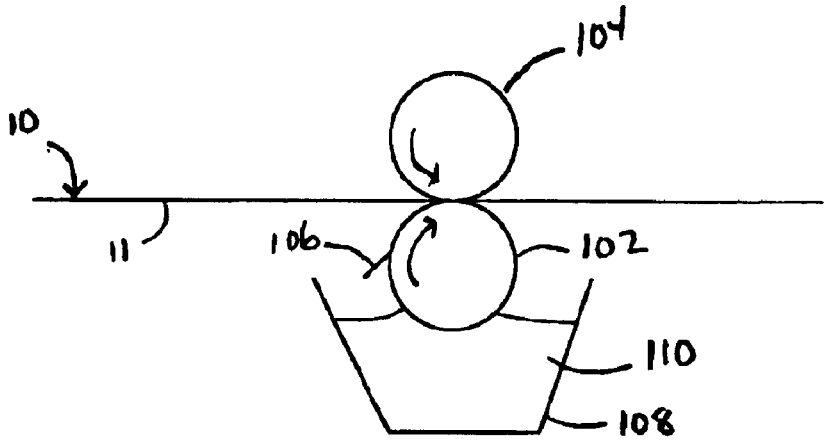
FIGS. 2A–2D show methods for applying an adhesive to the nonwoven web or the creping roll.
Figure 2B:
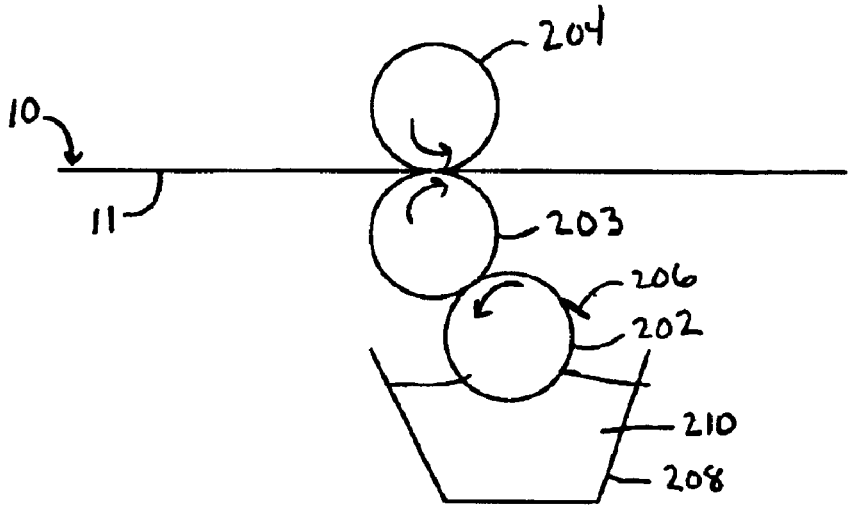
Figure 2C:
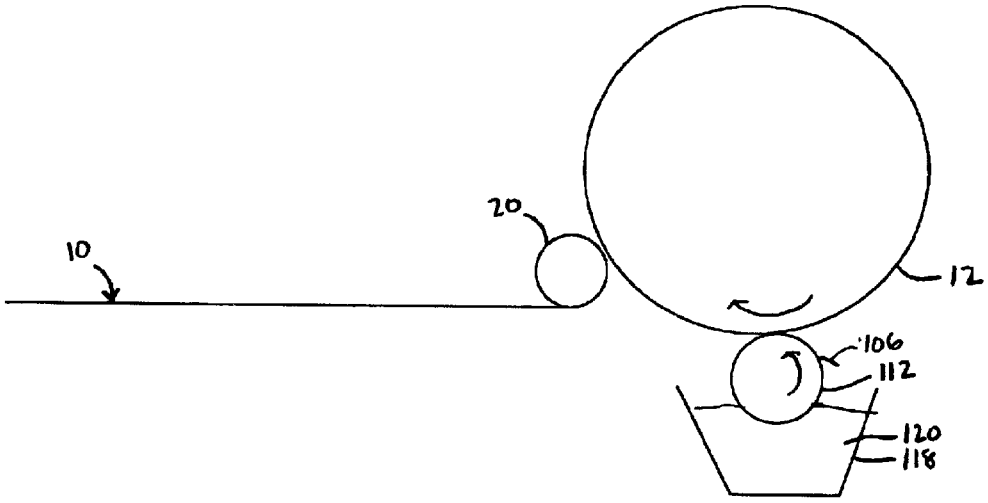
Figure 2D:
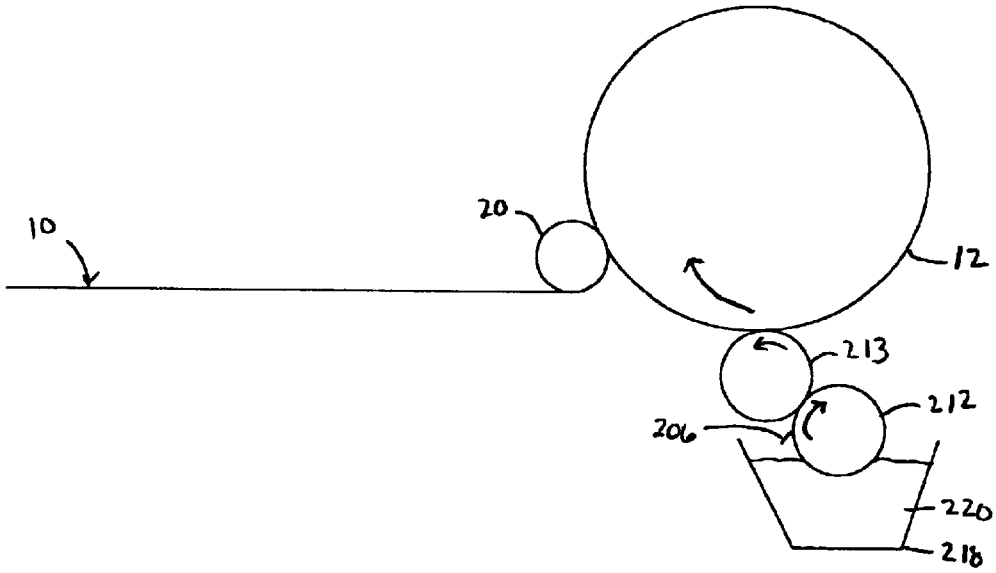

In the process of the present invention, when an external bonding agent is used, the adhesive can be applied to the nonwoven fibrous web 10 or to the creping roll 12. It is not critical to the present invention where the adhesive is applied. In addition, any known method of applying the external adhesive to the roll or nonwoven fibrous web can be used. Examples of suitable methods for applying the external adhesive include, but are not limited to, printing, blowing, spraying, dripping, splattering or any other technique capable of forming partial or total adhesive coverage on the thermoplastic nonwoven web or the creping roll. Of the known methods for applying the external adhesive, spraying and printing are preferred; however, it is not critical to the present invention how the external adhesive is applied to the nonwoven web 10 or creping roll 12. For example, the external adhesive may be sprayed onto the nonwoven fibrous web or onto the creping roll using spray methods known to those skilled in the art. In the alternative, the external adhesive may be wiped onto the nonwoven fibrous web or the creping roll. In another example, the external adhesive may be applied to the nonwoven fibrous web or the creping roll using a rotogravure applicator roll or a rotogravure offset applicator roll. These rotogravure processes are shown in FIG. 2, which will be discussed in more detail below. FIG. 2A shows using a rotogravure applicator roller (also called a "rotogravure roll") to apply the external adhesive to the nonwoven fibrous web 10. FIG. 2B shows using an offset roller to apply the adhesive to the nonwoven fibrous web 10. FIG. 2C shows using a rotogravure applicator roller to apply the external adhesive to the creping roll 12. FIG. 2D shows using an offset roller to apply the adhesive to the creping roll 12.

In FIG. 2A, a rotogravure applicator roller 102 is in communication with the reservoir 108 containing the adhesive 110. Although not shown in the FIG. 2A, a heating means may be supplied to the reservoir 108, especially if the adhesive 110 is a hot melt adhesive. Any heating means known to those skilled in the art can be used, so long as the hot melt adhesive is liquefied in the reservoir 108. Examples of heating means, include, but are not limited to, radiant heat. Rotogravure roller 102 picks up the liquid adhesive 110 from the reservoir 108 and carries the adhesive 110 upward onto the surface of the roller 102 as it rotates. The rotogravure roller 102 then contacts the first side 11 of the nonwoven web 10. A doctor blade 106 is provided to wipe or scrape off excess adhesive from the rotogravure roller 102 and to ensure that the adhesive 110 is uniformly covered on the rotogravure roller 102. Generally, adequate application of the adhesive to the nonwoven fibrous web can be obtained by laying the nonwoven fibrous web onto the rotogravure roll 102. However, a back-up roll 104 can be used to ensure that nonwoven fibrous web contacts the rotogravure roll 102. Further, the back-up roll 104 can provide a uniform contact pressure between the nonwoven web 10 and the rotogravure roll 102, thereby allowing the adhesive to be applied to the nonwoven web in a uniform coat throughout the length and width of the nonwoven web. The pressure at the nip between the backup roller 104 and the rotogravure roller 102 is selected to be sufficient to provide proper transfer of the adhesive. Excess pressure should be avoided to prevent a substantial reduction in the thickness of the nonwoven web, if the thickness of the nonwoven web is important in its end use.

In FIG. 2B, the adhesive is applied to the nonwoven using an offset roll 203. The rotogravure applicator roller 202 is in communication with the reservoir 208 containing the adhesive 210. As is noted above, although not shown in FIG. 2B, a heating means is supplied to the adhesive in the reservoir 208, especially if the adhesive is a hot melt adhesive. The rotogravure roller 202 picks up and carries the adhesive 210 upward onto the surface of the roller 202 as it rotates. The rotogravure roller 202 contacts the offset roll 203, which in turn contacts the first side 11 of the nonwoven web 10. A doctor blade 206 is provided to wipe or scrape off excess adhesive and to ensure that the adhesive 210 is uniformly covered on the rotogravure roller and the offset roll 203. Generally, adequate application of the adhesive to the nonwoven web can be obtained by laying the nonwoven fibrous web 10 onto the offset roll 203. However, a back-up roll 204 can be used to ensure that nonwoven fibrous web contacts the offset roll 203. Further, the back-up roll 204 can provide a uniform contact pressure between the nonwoven fibrous web 10 and the offset roll 203, thereby allowing the adhesive to be applied to the nonwoven web in a uniform coat throughout the length and width of the web. The pressure at the nip between the backup roller 204 and the offset roll 203 is selected to be sufficient to provide proper transfer of the adhesive. Excess pressure should be avoided to prevent a substantial reduction in the thickness of the nonwoven fibrous web, if the thickness of the nonwoven web is important in its end use.

In a similar manner to the method of applying the external adhesive to the nonwoven web using a rotogravure roll, FIG. 2C demonstrates the application of the adhesive to the creping roll using a rotogravure roll. In this method, a rotogravure applicator roller 112 is in communication with the reservoir 118 containing the adhesive 120. Again, heat may be supplied to the adhesive in the reservoir 118, especially if the adhesive is a hot melt adhesive, so that the adhesive is liquefied. The rotogravure roller 112 picks up the liquid adhesive 120 from the reservoir 118 and carries the adhesive 120 upward onto the surface of the roller 112 as it rotates. The rotogravure roller 112 contacts the creping roll 12, transferring the adhesive to the creping roll. A doctor blade 106 is provided to wipe or scrape off excess adhesive and to ensure that the adhesive 120 is uniformly covered on the rotogravure roller.

In a similar manner to the method of applying the hot melt adhesive to the nonwoven web using an offset roll, FIG. 2D demonstrates the application of the external adhesive to the creping roll using an offset roller. A rotogravure applicator roller 212 is in communication with the reservoir 218 containing the adhesive 220 and carries the adhesive 220 upward onto the surface of the roller 212 as it rotates. The rotogravure roller 212 contacts offset roll 213 and transfers the adhesive to the offset roll 213. The offset roll 213 then contacts the creping roll 12, transferring the adhesive to the creping roll. A doctor blade 206 is provided to wipe or scrape off excess adhesive and to ensure that the adhesive 220 is uniformly covered on the rotogravure roller 212, which in turn ensures a uniformly covering of the adhesive of the offset roll 213 and the creping roll 12.

Using a rotogravure roll or an offset roll has the advantage of being capable of applying a very uniform thin coating of the hot melt adhesive to the nonwoven fibrous web or roll. However, spraying the adhesive onto the nonwoven web or the creping roll can also accomplish this same result.

As is demonstrated in FIGS. 2A–D, the adhesive may be applied to the first side 11 of the nonwoven web 10 prior to contacting the first side 11 of the nonwoven web with the creping roll, or, in the alternative, an adhesive may be applied to the creping roll. It is not critical to the present invention whether the adhesive is applied to the nonwoven web or the creping roll. Nor is it critical to the present invention which method is used to apply the adhesive.

In the creping process of the present invention, the nonwoven fibrous web is at least partially coated on one side with an adhesive, so that about 5–100%, preferably about 10–70%, and more preferably about 25–50% of the total surface area on one side of the nonwoven web is coated.

Hence, about 0–95%, preferably about 30–90% and more preferably about 75–50% of the area of the nonwoven web is uncoated. In the alternative, about 5–100%, preferably about 10–70%, and more preferably about 25–50% of the total surface area of the creping roll is coated. This translates to about about 0–95%, preferably about 30–90% and more preferably about 75–50% of the area of the creping roll is uncoated. The thickness of the adhesive on the nonwoven web or creping roll determines the amount of adhesive which will be present on the nonwoven web. The weight amount of the adhesive on the nonwoven is called the "add-on". Desirably, the amount of the add-on adhesive should be in the range of about 0.1% to about 10% by weight, based on the weight of the nonwoven web. Preferably, the amount of the adhesive add-on should be in the range of about 1% to about 3.5% by weight, based on the weight of the nonwoven web.

In the case of where an internal adhesive is added to the polymer used to prepare the nonwoven fibrous web, it is not necessary to place an adhesive on the creping roll. However, it is not outside the scope of the present invention to use both an internal adhesive and an external adhesive in the method.

Returning to the description of FIG. 1, once the nonwoven web 10 is adhered to the creping roll 12, the nonwoven fibrous web stays attached to the creping roll 12 as the creping roll rotates. The nonwoven fibrous web 10 is brought into contact with the bonding roll 16. The bonding roll 16 has raised portions and recessed portions. As the nonwoven web is passed between the nip created between the bonding roll 16 and the creping roll 12, the raised portions of the bonding roll come into contact with the nonwoven fibrous web 10. These raised portions of the bonding roll bond the fibers of the nonwoven fibrous web together at the points of contact. In order to bond the fibers of the nonwoven fibrous web 10, the bonding roll 16, may be heated to melt the filaments at the contact points.

The bonding roll can have any bond pattern known to those skilled in the art. The actual bond pattern is not critical to the present invention. Examples of bond patterns include, but are not limited to, point bonded or point unbonded (PUB) bond patterns. Generally the bonding roll is heated to a temperature sufficiently high enough to melt the fibers of the nonwoven fibrous web. The actual temperature to which the bonding roll is heated depends on the polymers used to make the nonwoven fibrous web. For most thermoplastic polymers, the bonding roll is heated in the range of about 200° F. to about 500° F. In addition, the bonding roll 16 also exerts pressure on the nonwoven fibrous web. Pressure up to about 3000 pounds per linear inch, or more may be used. Typically pressures are in the about 500 pli to about 2000 pli range. Other methods of bonding such as ultrasonic bonding can be used in the present invention.

As the nonwoven fibrous web 10 is passed between the nip of the bonding roll and the creping roll, the bonding roll 16 further adheres the nonwoven fibrous web to the creping roll 12. The adhesive applied to the nonwoven fibrous web or the creping roll is typically concentrated to a greater extent at the interfilament-bond areas, causing still greater interfilament bonding in those areas. Essentially, the nonwoven fibrous web 10 is attached to the creping roll 12 in the pattern of the bonding roll 16.

Returning to FIG. 1, as the creping roll moves toward the creping blade 14, the leading edge of the nonwoven web bonded to the surface is creped off the creping roll by the action of the creping blade 14. The creping blade 14 penetrates the adhesive bond between the nonwoven fibrous web and the creping roll 12, lifting the nonwoven web off the creping roll 12. Since the nonwoven fibrous web is essentially attached to the creping roll in the bond pattern of the bonding roll, the resulting permanent filament bending in the bonded areas corresponding to the nonwoven web bond pattern. This results in permanent looping of the filaments in the unbonded areas or areas of the nonwoven web which are less attached to the creping roll, and creping primarily occurs at the bond points of the nonwoven fibrous web.

The creped nonwoven web 18 is then advance by pull rolls 24 into a winder (not shown) to form a wound roll of the creped nonwoven web 22. Once rolled, the creped nonwoven web can be transferred to another location and further processed to form final products containing the creped nonwoven web. In the alternative, although not shown in FIG. 1, the creped nonwoven web 18 could be further processed in-line to form a final product from the creped nonwoven web. An example of further processing includes, but is not limited to creping the second side 21 of the nonwoven web to form a nonwoven web which is creped on both sides.

In the process of the present invention, it is preferred that the bonding roll has a regular point bond pattern. Using the point bond pattern results in a creped nonwoven web having regular looping in the unbonded areas, as described above. The resulting creped nonwoven web has fairly regular creping pattern and lower bulk and higher permeability than the uncreped nonwoven web or a nonwoven web which is bonded and creped in a two step process, i.e. a process where one set of bonding rolls is used to bond the nonwoven fibrous web and a separate creping roll is used to crepe the nonwoven web. The creped nonwoven web prepared by the method of the present invention is a looped material having a fairly low bulk density and fairly large void volumes.

The bulk density of the creped nonwoven web is generally about one half of the bulk density of the uncreped nonwoven web. In addition, the void volume is generally in the range of about 0.5 cc/g to about 4.0 cc/g. Of course the bond pattern of the bonding roll will cause the void volume and bulk density to vary. That is, if the bonding roll results in a nonwoven web having a fairly high percentage of bonding, the size of the loops will be reduced and the bulk density will increase and the void volume will decrease.

The process described above only crepes one side of the nonwoven web being creped. When both sides of the nonwoven fibrous web are creped, the process of the first method further includes e) transferring and adhering the second side of the nonwoven web to a third roll by contacting the second side of the nonwoven fibrous web with the third roll; and f) removing the nonwoven web adhered to the third roll by creping the nonwoven fibrous web from third roll with a creping blade to produce a creped thermoplastic nonwoven web which is creped on both the first and second sides.

Figure 3:
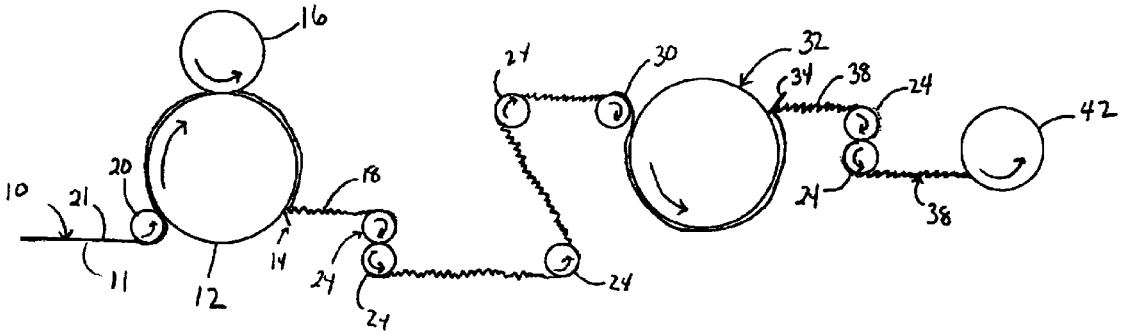
FIG. 3 shows a schematic diagram of the apparatus used to crepe both sides of the nonwoven web.

In FIG. 3, a process for producing a creped nonwoven web which has been creped on both sides of the web is shown. The process is similar to FIG. 1, but instead of rolling the creped nonwoven web 18 onto a roll, the second side 21 of the nonwoven web 10 is creped.

A first press roll 20 engages the first side 11 of the nonwoven web 10 with a first creping roll 12 by guiding the nonwoven web 10 onto the first creping roll 12. The first press roll 20, when present, supplies sufficient pressure to the nonwoven web 10 to adhere the nonwoven web 10 to the first creping roll 12. Again, it is pointed out that an adhesive must be applied to the first side of the nonwoven fibrous web or onto the creping roll 12 before the nonwoven web is contacted with the creping roll 12, if the nonwoven web does not contain an adhesive additive within the polymeric fibers. The methods which can be used to apply the adhesive are described above and some of the methods are shown in FIGS. 2A–2D. The description of adhesive application process is given above. The nonwoven fibrous web 10 is brought into contact with the bonding roll 16. The bonding roll 16 has raised portions and recessed portions. As the nonwoven web is passed between the nip created between the bonding roll 16 and the creping roll 12, the raised portions of the bonding roll come into contact with the nonwoven fibrous web. These raised portions of the bonding roll bond the fibers of the nonwoven fibrous web together at the points of contact. In order to bond the fibers of the nonwoven fibrous web, the bonding roll 16, may be heated to melt the filaments at the contact points.

The once creped nonwoven web 18 is then advance by pull rolls 24 to a second press roll 30 and a third roll 32, also called "a second creping roll". The second press roll 30 engages the nonwoven web 18 with the second creping roll 32 by guiding the creped nonwoven web 18 onto the second creping roll 32, such that the second side 21 of the nonwoven web 10 is brought into contact with the second creping roll 32. Again, in order to adhere the nonwoven web to the creping roll, an adhesive must be applied to the second side 21 of the nonwoven fibrous web or the second creping roll 32, if the polymeric components of the nonwoven web does not contain an adhesive additive. The methods which can be used to apply the adhesive are described above and some of the methods are shown in FIGS. 2A–2D. The description of adhesive application process is given above.

Once the once creped nonwoven web 18 is adhered to the second creping roll 32, the once creped nonwoven web is brought into contact with a second creping blade 34. The action of the second creping blade 34 removes the creped nonwoven web 18 from the second creping roll 32, which results in a twice creped nonwoven web 38, having a controlled crepe on both sided of the web.

The twice creped nonwoven web 38 is then advanced by pull rolls 24 into a winder (not shown) to form a wound roll of the creped nonwoven web 42. Once rolled, the creped nonwoven web 38 can be transferred to another location and further processed to form final products containing the creped nonwoven web. In the alternative, although not shown in the figures, the twice creped nonwoven web 38 could be further processed in-line to form a final product from the twice creped nonwoven web.

In practicing the present invention, the creping rolls 12 and 32 can each independent of one another, be a smooth roll or a roll with a textured surface. In the practice of the present invention, it is preferred that the creping rolls are smooth rolls.

In the processes shown in FIG. 1 and FIG. 3, which are described above, it is noted that either the adhesive is applied to the nonwoven web or to the creping roll and preferably not to both at the same time. However, applying the adhesive to both the nonwoven web and the creping roll is not outside the scope of the present invention.

The doctor blade (creping blade) used in the process of the present invention can be made of various materials including, but not limited to, ceramic coated steel, spring steel and brass. The blade is typically cut at an angle ranging from about 5 to about 45 degrees. Preferably, the doctor blade is cut at an angle in the range of about 10 to about 25 degrees. In addition, the tension of the blade against the creping roll should be in the range of about 5 to about 150 pounds per linear inch.

In addition to the adhesive additive, other additives, such as processing aids, filler, pigments, slip agents and the like, may be also be added to the thermoplastic polymer.

Typically, the level of creping achieved using the process of the present invention is in the range of about 1 to about 75%. Generally, however, the level of creping is in the range of about 5 to about 50%, more preferably, between about 10 and about 40%.

The creped nonwoven webs produced by the process of the present invention have improved permeability, conductance, and a larger pore volume as compared to the uncreped nonwoven web. In addition the density of the creped nonwoven web is less than the uncreped nonwoven web and the creped nonwoven web has a greater thickness than the uncreped nonwoven. Finally, the creped nonwoven webs of the present invention typically exhibit a low initial modulus, almost in the elastic region, up to an elongation about equal to the crepe level.

EXAMPLES

Example 1

Using the process shown in FIG. 1, a spunbond having a basis weight of 0.4 osy and about 3.5 denier fiber produced from polypropylene (Exxon 3155) was supplied directly from the nonwoven web forming wire in an unbonded form. A hot-melt adhesive NS 34-2950, available from Nations Starch and Chemical was sprayed onto a smooth creping roll through a spray head having 30 holes per liner inch, each hole having about 0.020 inch diameter. The spray rate was such that the nonwoven fibrous web had about 1% by weight adhesive add-on to the nonwoven web. A press roll applying a pressure of about 35 pounds per linear inch adhered the nonwoven fibrous web to the creping roll. The creping roll was heated to a surface temperature of about 135° F. The nonwoven fibrous web was passed through a nip created by the creping roll and a H&P pattern bond roll having 200 pins per square inch and a 26% bond area. The pattern bond roll was heated to a temperature of about 302° F. and applied a pressure of about 800–1100 pounds per linear inch to the nonwoven fibrous web, thereby bonding the fibers of the nonwoven fibrous web and further adhering the nonwoven fibrous web to the creping roll. A spring steel doctor blade applied about 15 pounds per linear inch to remove the bonded nonwoven web from the creping roll. The nonwoven fibrous web was successfully bonded and creped on the creping surface. The resulting creped nonwoven web had an uniform creped structure in the pattern of the bond roll.

Example 2

Using the process shown in FIG. 1, a spunbond having a basis weight of about 0.4 osy and about 3.5 denier fiber produced from a mixture of 95 parts by weight polypropylene (Exxon 3155) and 5 parts by weight of an adhesive additive Shell 8911 (ethylene/butylene copolymer) was prepared. The unbonded fibers were supplied directly from the nonwoven web forming wire to the process shown in FIG. 1, except the press roll 20 was not utilized. The nonwoven fibrous web was brought into contact with the creping roll. The creping roll was heated to a surface temperature of about 280° F. The nonwoven fibrous web was passed through a nip created by the creping roll and a H&P pattern bond roll having 200 pins per square inch and a 26% bond area. The pattern bond roll was heated to a temperature of about 310° F. and applied a pressure of about 800–1100 pounds per linear inch to the nonwoven fibrous web, thereby bonding the fibers of the nonwoven fibrous web and adhering the nonwoven fibrous web to the creping roll in the pattern of the bonding roll. A spring steel doctor blade applied about 15 pounds per linear inch to remove the bonded nonwoven web from the creping roll. The nonwoven fibrous web was successfully bonded and creped on the creping surface, resulting in a creped nonwoven web which had a uniform creped structure in the pattern of the bond roll.

Example 3

Example 2 was repeated except a wire weave pattern bond roll having 302 pin per square inch and a 17% bond area was used instead of the H&P bond roll. Again, the nonwoven fibrous web was successfully bonded and creped on the creping surface, resulting in a creped nonwoven web which had a uniform creped structure in the pattern of the bond roll.

Example 4

Using the process shown in FIG. 1, a spunbond having a basis weight of about 0.4 osy and about 3.5 denier fiber produced from a mixture of 90 parts by weight polypropylene (Exxon 3155) and 10 parts by weight of an adhesive additive Shell 8911 (ethylene/butylene copolymer) was prepared. The unbonded fibers were supplied directly from the nonwoven web forming wire to the process shown in FIG. 1, except the press roll 20 was not utilized. The nonwoven fibrous web was brought into contact with the creping roll. The creping roll was heated to a surface temperature of about 255° F. The nonwoven fibrous web was passed through a nip created by the creping roll and a H&P pattern bond roll having 200 pins per square inch and a 26% bond area. The pattern bond roll was heated to a temperature of about 310° F. and applied a pressure of about 800–1100 pounds per linear inch to the nonwoven fibrous web, thereby bonding the fibers of the nonwoven fibrous web and adhering the nonwoven fibrous web to the creping roll in the pattern of the bonding roll. A spring steel doctor blade applied about 15 pounds per linear inch to remove the bonded nonwoven web from the creping roll. The nonwoven fibrous web was successfully bonded and creped on the creping surface, resulting in a creped nonwoven web which had a uniform creped structure in the pattern of the bond roll.

Example 5

Example 4 was repeated except a wire weave pattern bond roll having 302 pin per square inch and a 17% bond area was used instead of the H&P bond roll. Again, the nonwoven fibrous web was successfully bonded and creped on the creping surface, resulting in a creped nonwoven web which had a uniform creped structure in the pattern of the bond roll.

The creped nonwoven web of the present invention can be used as wipes, liners, transfer or surge layers, outercovers, other fluid handling materials and looped fastener materials for hook and loop fasteners.

While the invention has been described in detail with respect to specific embodiments thereof, it will be apparent to those skilled in the art that various alterations, modifications and other changes may be made without departing from the spirit and scope of the present invention. It is therefore intended that all such modifications, alterations and other changes be encompassed by the claims.

What is claimed is:

1. A method for preparing a pattern bonded and creped nonwoven web comprising a) providing a nonwoven fibrous web having a first side and a second side, the nonwoven fibrous web comprises continuous thermoplastic fibers;

b) transferring and adhering the nonwoven fibrous web to a first roll, such that the first side of the nonwoven fibrous web faces the first roll;

c) bonding the nonwoven fibrous web transferred and adhered to the first roll by contacting the fibrous web with a second roll comprising a pattern, such that the nonwoven fibrous web is passed between a nip formed between the first roll and the second roll to form a bonded nonwoven web; and d) removing the bonded nonwoven web from the first roll by creping the bonded nonwoven web from the first roll to produce a creped nonwoven web.

2. The method of claim 1, wherein the nonwoven fibrous web is provided directly from the nonwoven fibrous web forming process.

3. The method of claim 2, wherein the nonwoven fibrous web forming process is a spunbond process.

4. The method of claim 2, wherein the nonwoven fibrous web forming process is a laminate process comprising at least one spunbond layer and at least one meltblown layer.

5. The method of claim 1, wherein the nonwoven fibrous web is transferred and adhered to the first roll by applying an adhesive to the first roll, to the first side of the nonwoven web or to both the first side of the nonwoven web and the first roll.

6. The method of claim 5, wherein the adhesive is placed on the first roil by a method selected from the group consisting of printing, spraying and dipping.

7. The method or claim 5, wherein the adhesive is placed on the first side of the nonwoven fibrous web by a method selected from the group consisting of printing, spraying and dipping.

8. The method of claim 5, wherein the adhesive is a hot melt adhesive.

9. The method of claim 1, wherein the nonwoven fibrous web comprises an adhesive component in a thermoplastic polymeric component of the thermoplastic fibers of the nonwoven fibrous web and the adhesive component adheres the nonwoven fibrous web to the first roll when the nonwoven web is transferred to the first roll.

10. The method of claim 9, further comprising e) transferring and adhering the second side of the nonwoven web to a third roll by contacting the second side of the nonwoven fibrous web with the third roll; and f) removing the nonwoven fibrous web adhered to the third roll by creping the nonwoven fibrous web from the third roll with a creping blade to produce a creped thermoplastic nonwoven web which is creped on both the first and second sides.

11. The method of claim 1, wherein the second roll has a pattern of raised portions which contact the nonwoven fibrous web causing the nonwoven fibrous web to comprise interfiber bonds in the pattern of the raised portions.

12. The method of claim 11, wherein the second roll has a pattern of discontinuous raised portions.

13. The method of claim 12, wherein the second roll has a point bonded pattern.

14. The method of claim 11, wherein the second roll has a pattern of continuous raised portions.

15. The method of claim 1, wherein the first roll has a smooth surface.

16. The method of claim 1, further comprising e) transferring and adhering the second side of the nonwoven web to a third roil by contacting the second side of the nonwoven fibrous web with the third roll using an adhesive to adhere the second side of the nonwoven fibrous web to the third roll; and f) removing the nonwoven fibrous web adhered to the third roll by creping the nonwoven fibrous web from the third roll with a creping blade to produce a creped thermoplastic nonwoven web which is creped on both the first and second sides.

17. The method of claim 16, wherein the adhesive is a hot melt adhesive.

18. The method of claim 16, wherein the adhesive is placed on the third roll by a method selected from the group consisting of printing, spraying and dipping.

19. The method of claim 16, wherein the adhesive is placed on the second side of the nonwoven fibrous web by a method selected from the group consisting of printing, spraying and dipping.

* * * * *